US006186936B1

(12) United States Patent
Smith et al.

(10) Patent No.: US 6,186,936 B1
(45) **Date of Patent: *Feb. 13, 2001**

(54) PAPER EMBOSSING SYSTEM WITH A FLEXIBLE COUNTER AND METHOD OF EMBOSSING

(75) Inventors: Ronald R. Smith, Kansas City, MO (US); Scott A. Schimke, Lansing, KS (US)

(73) Assignee: Hallmark Cards, Incorporated, Kansas City, MO (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/034,502

(22) Filed: Mar. 4, 1998

(51) Int. Cl.[7] ..... B31B 1/88; B31B 43/00; B41M 1/40; B41N 1/00

(52) U.S. Cl. ..... 493/338; 493/58; 101/295; 101/211

(58) Field of Search ..... 493/338, 58, 902, 493/955; 100/211, 295; 264/316, 313, 299; 101/28, 3.1; 425/385; 269/310, 275, 274, 266; 72/57, 60, 465.1, 466.8

(56) References Cited

U.S. PATENT DOCUMENTS

| | | | | |
|---|---|---|---|---|
| 118,005 | | 8/1871 | Foote | 101/28 |
| 444,835 | | 1/1891 | Hobson | 101/28 |
| 1,161,881 | | 11/1915 | Petrelius | 101/493 |
| 1,704,567 | | 3/1929 | Grünberg | 101/3.1 |
| 1,856,928 | | 5/1932 | Pannier, Jr. | 101/28 |
| 2,005,340 | | 6/1935 | Jaffin et al. | 101/28 |
| 2,350,033 | | 5/1944 | Hebenstreit | 101/379 |
| 2,492,886 | * | 12/1949 | Punte | 493/58 |
| 2,748,696 | | 6/1956 | Murray | 101/41 |
| 3,557,277 | | 1/1971 | Brodersen et al. | 264/316 |
| 3,748,889 | * | 7/1973 | Miller et al. | 72/466.8 |
| 4,867,057 | | 9/1989 | Bradley et al. | 101/21 |
| 5,540,153 | | 7/1996 | Campbell et al. | 101/493 |
| 5,897,108 | * | 4/1999 | Gordon et al. | 269/310 |

FOREIGN PATENT DOCUMENTS

| | | | |
|---|---|---|---|
| 4240527 | 6/1994 | (DE) | B44C/1/24 |
| 0553626 | 8/1993 | (EP) | B41F/5/00 |

OTHER PUBLICATIONS

Pp. 287–291 from book entitled "Manufacturing Processes and Materials for Engineers", Second Edition, Lawrence E. Doyle, Prentice–Hall, Inc., Englewood Cliffs, N.J., © 1961, 1969.

Pages from the Web Site of Urethane Tooling & Engineering Corporation, Scottsdale, Arizona, dated Oct. 18, 1996.

Product Data Sheet for CC010 Countercast Tuff Film from Astor Universal, Lawrence, Kansas, dated May 22, 1996.

* cited by examiner

*Primary Examiner*—Brian L. Johnson
*Assistant Examiner*—Matthew Luby
(74) *Attorney, Agent, or Firm*—Leydig, Voit & Mayer, Ltd.; John M. Augustyn

(57) ABSTRACT

A flexible counter for an embossing system provides resilient support under a sheet which opposes pressure from a contoured die forming an embossment in the sheet. The flexible counter includes a resilient mat and a fixed bolster which supports the mat. The bolster has a peripheral wall which extends around sides of the mat so that an upper portion of the mat protrudes above the peripheral wall. In addition, the bolster includes support surfaces bounded by recesses. The support surfaces support a bottom surface of the mat, and the recesses receive bulging portions of the mat when compressed under pressure from the die.

40 Claims, 5 Drawing Sheets

PAPER EMBOSSING SYSTEM WITH A FLEXIBLE COUNTER AND METHOD OF EMBOSSING

FIELD OF THE INVENTION

The invention relates to a system for embossing paper, such as greeting cards, and more particularly relates to an embossing system having an improved flexible counter for supporting a sheet of paper for pressing by a female die.

BACKGROUND

Embossing systems are used to form an embossment or decoratively raised area on a sheet of paper or cardboard. Such an embossment may serve as a decorative feature on a greeting card, business card, or the like. Conventional embossing systems include matable male and female dies contoured in the shape of the desired embossment. With a sheet (e.g., paper) disposed between the two dies, the male and female dies are pressed together in complementary engagement with each other. The paper is thereby deformed to have an embossment matching the contour of the dies.

In an embossing system with mated dies, expenses are incurred for making both the male and female dies. Additionally, such a system requires regular attention to maintain precise die alignment for repeated mating engagement.

Attempts have been made to eliminate the male die component by instead providing a flexible "counter" to support a paper being pressed by the female die. Unfortunately, known flexible counter systems have not provided suitable embossing results. Basically, known counters include a flexible mat which supports the paper during pressing by female die. Some known counters include a structure that contains all but one side of the mat. These known flexible counters often tear the paper during embossing or result in an unsuitable embossment. Such performance shortcomings may be due to poor deformation behavior or "flow" characteristics of the mat as supported by these known counters.

SUMMARY OF THE INVENTION

The present invention provides improved embossing performance in a system for embossing areas on greeting card material, paper or cardboard products or other items. A flexible counter is provided to support the material being embossed by opposing pressure from a female die. The flexible counter has a resilient mat which resides in a fixed bolster. According to the invention, the bolster is constructed to form recesses which receive bulging deformation of the mat material as the mat is compressed by the opposing die forces. By accommodating bulging of lower portions of the mat, deformation of upper portions of the mat are controlled to reduce stretching behavior of the upper mat surface which supports the sheet, and thereby optimize embossing performance.

According one aspect of the invention, the bolster has a sidewall which extends generally around a periphery of the mat so that an upper portion of the thickness of the mat extends above the sidewall. Another aspect of the invention provides that the bolster has at least one support surface which is adjacent to a recess. The support surface supports a bottom surface of the mat, and the recess receives a bulging portion of the mat as the mat deforms under compression of the embossing die.

In an embodiment, the bolster has a plurality of support surfaces. These support surfaces may be formed by buttons of various shapes, loop-shaped elements or other appropriately-shaped support members. The bolster may also have a fixed floor to which such support members and sidewalls are mounted. The buttons or other support members are preferably spaced apart from each other to form the recesses.

Embodiments of the invention may include additional features found to enhance performance. For example, a friction-reducing film, such as a mylar or urethane film, may be positioned over the mat to separate the mat from the sheet. The friction-reducing film reduces damage to the sheet and aids in removing the sheet from the counter after embossing.

A recess may be provided around a lower periphery of the mat. In an embodiment, such a peripheral recess may be defined by a chamfered interior edge of the sidewall.

An advantage of the present invention is that it provides reliable embossing performance while minimizing damage to the material being embossed.

Another advantage of the present invention is that it permits embossing with a female die, eliminating a need for a mated male die, reducing material expenses.

A related advantage of the present invention is that it eliminates a need to maintain precise die alignment, reducing maintenance effort and associated down time of the system.

Additional features and advantages of the invention are described in, and will be apparent from, the disclosure herein.

DESCRIPTION OF EMBODIMENTS

Figure 1:
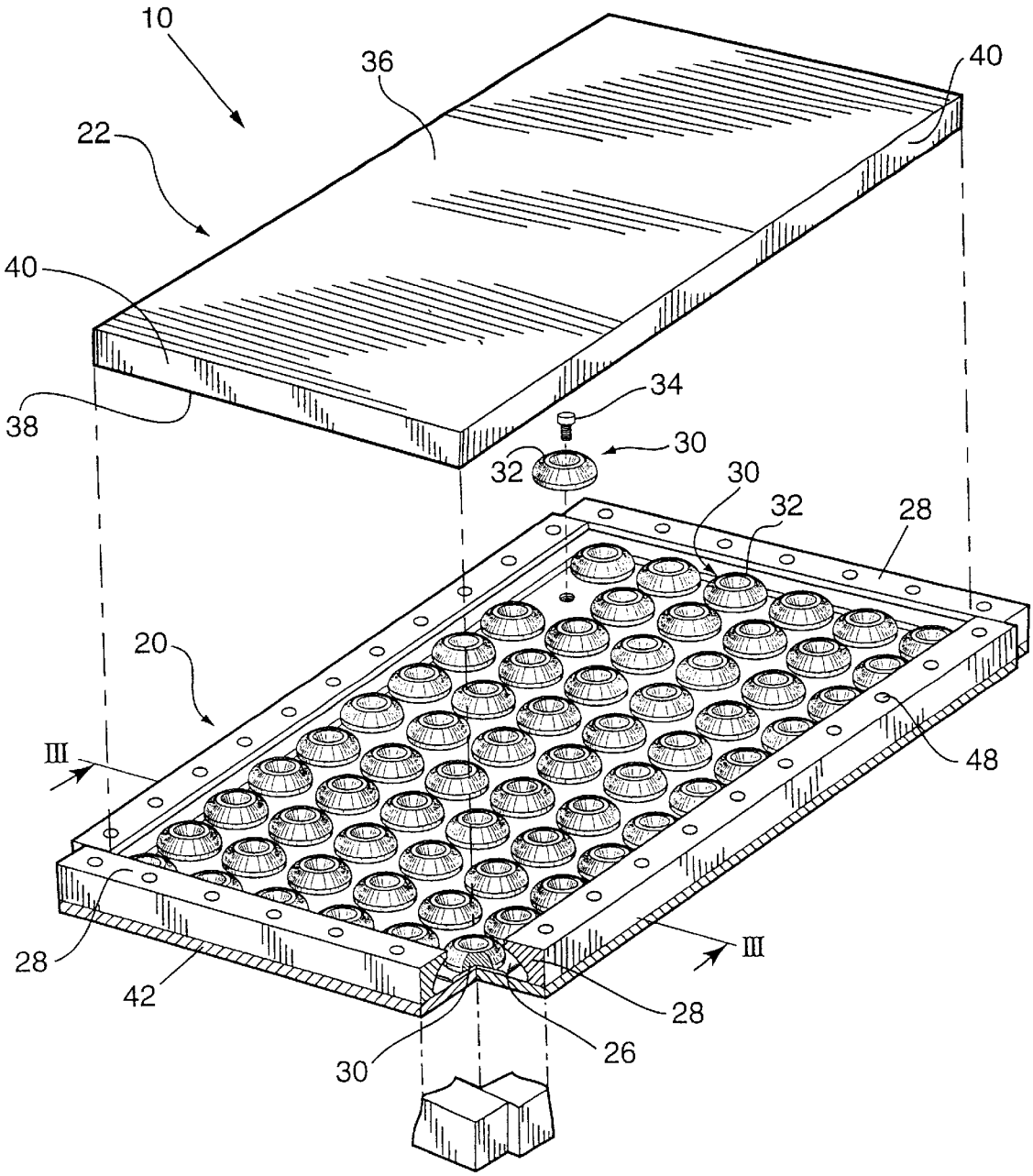
FIG. 1 is a partially exploded perspective view of a flexible counter, including a flexible mat and a bolster with circular buttons constructed in accordance with teachings of the invention, a broken-away portion of the bolster showing a chamfer along an interior of peripheral walls of the bolster.

Now referring to the Figures, wherein like numerals designate like components, FIG. 1 shows a flexible counter 10 according to the invention. The flexible counter 10 generally includes a bolster 20 and a generally rectilinear resilient mat 22 supported by the bolster 20. The flexible counter 10 is constructed to resiliently support a sheet 24 (FIGS. 2–4 ) during an embossing operation and is particularly useful in an automated embossing operation wherein embossments are formed on paper sheets during the manufacturing of greeting cards, business cards or the like.

Figure 3:
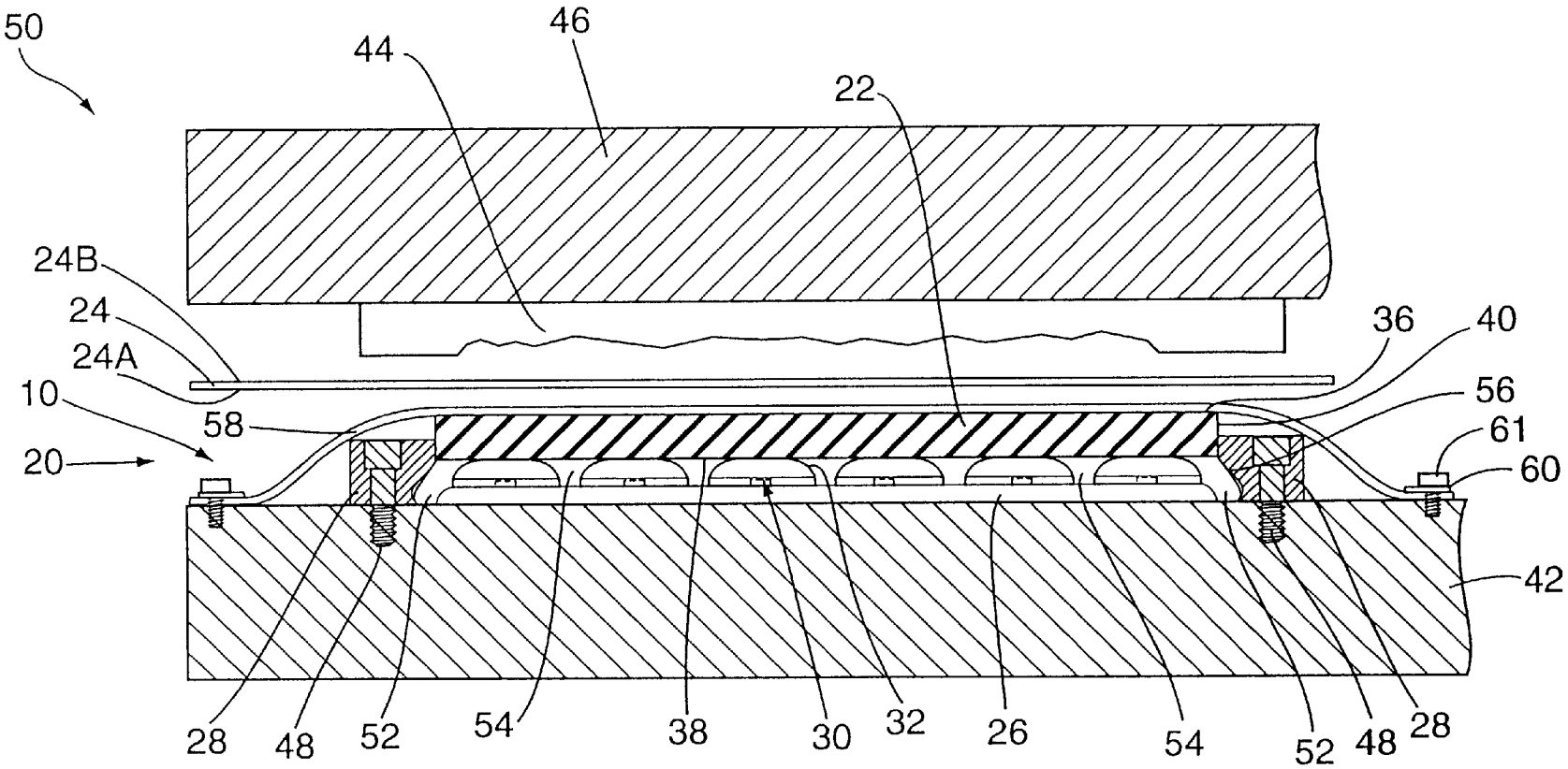
FIG. 3 is a sectional side view of a press assembly having a die positioned above a flexible counter according to the invention.

As illustrated in FIGS. 1 and 3, the bolster 20 generally includes a plate-like floor 26, four side walls 28 mounted relative to the floor 26 defining a periphery of the bolster 20, and a plurality support members or circular buttons 30 mounted to the floor 26. Each of these buttons 30 forms a support surface 32 for supporting the mat 22. In the embodiment illustrated in FIG. 1, each button 30 has a center hole through which a screw 34 secures the button 30 to the floor 26. The buttons 30 may be provided in other suitable shapes, as explained below.

The mat 22 has an upper surface 36, a lower surface 38, and four side surfaces 40. The mat 22 fits closely within the four walls 28 of the bolster 20 and rests atop the buttons 30 so that the lower surface 38 of the mat 22 contacts the support surfaces 32. As shown in FIG. 3, the mat 22 and bolster 20 are dimensioned so that a portion of the thickness of the mat 22 protrudes above the peripheral walls 28 of the bolster 20. For example, about one-half to one-third of the thickness of the mat 22 may protrude above the walls 28 of the bolster 20. The mat 22 may have a thickness in the range of 0.125 inches to 2.0 inches and a preferred thickness of about 0.5 inches.

The mat 22 may be made of various natural or synthetic elastomers which have appropriate resilience. For example, natural gum rubber has been found to exhibit favorable properties. Other suitable materials may include buna-n rubber, neoprene, silicon, sorbothane, EPDM rubber, urethane, cotton, reinforced neoprene and hypalon. In one embodiment, the mat would have the following characteristics:

| | First Range | Second Range | Preferred |
|---|---|---|---|
| Hardness (Durometer) Shore A | 30–60 | 35–45 | 40 |
| Tensile Strength (psi) | 2000–6000 | 3000–4500 | 4000 |
| Heat Stability Fahrenheit | −20°–300° | −20°–140° | 175° |

Figure 2:
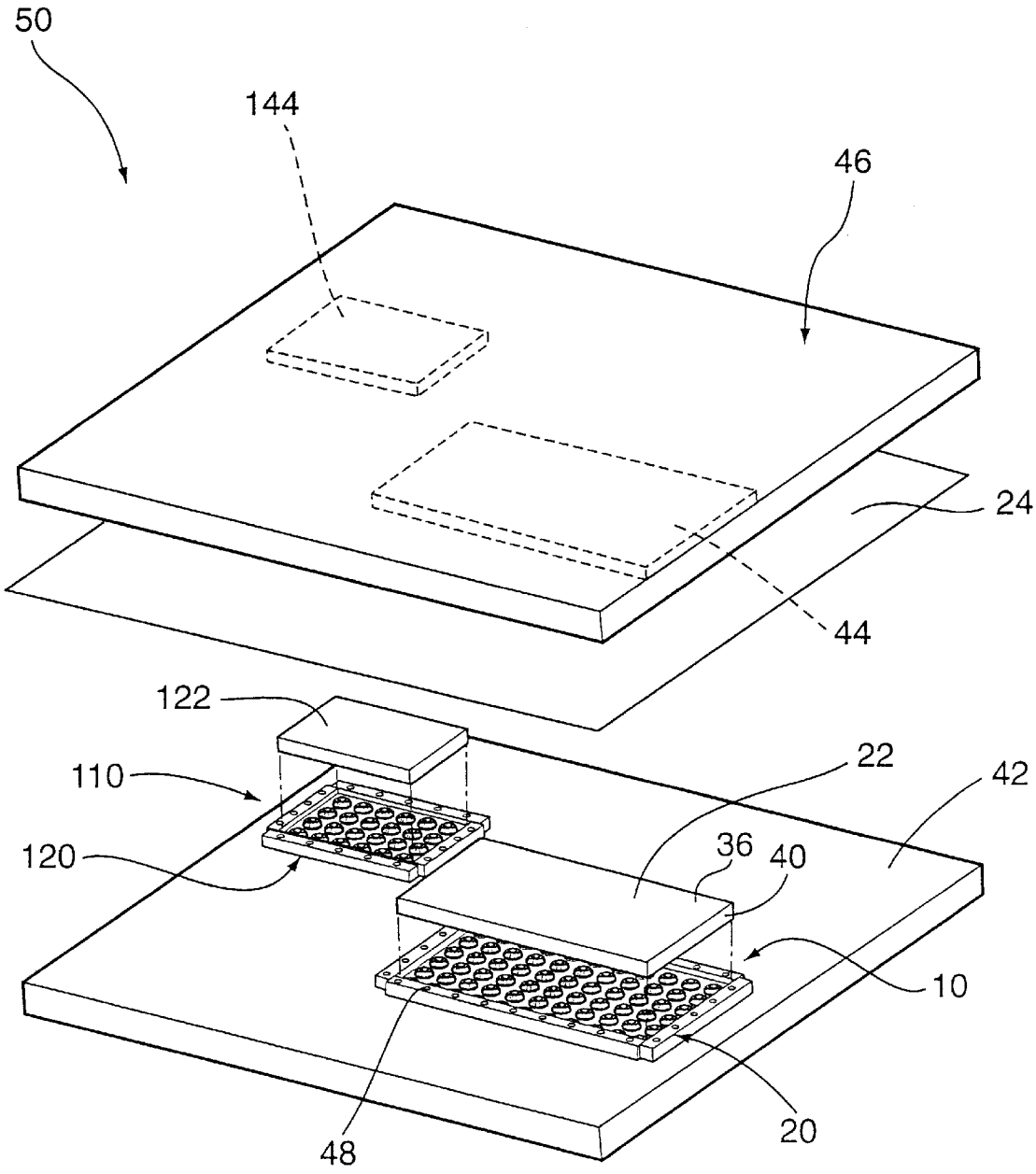
FIG. 2 is an exploded perspective view of an embossing press assembly which includes multiple dies and flexible counters according to an embodiment of the invention.
Figure 4:
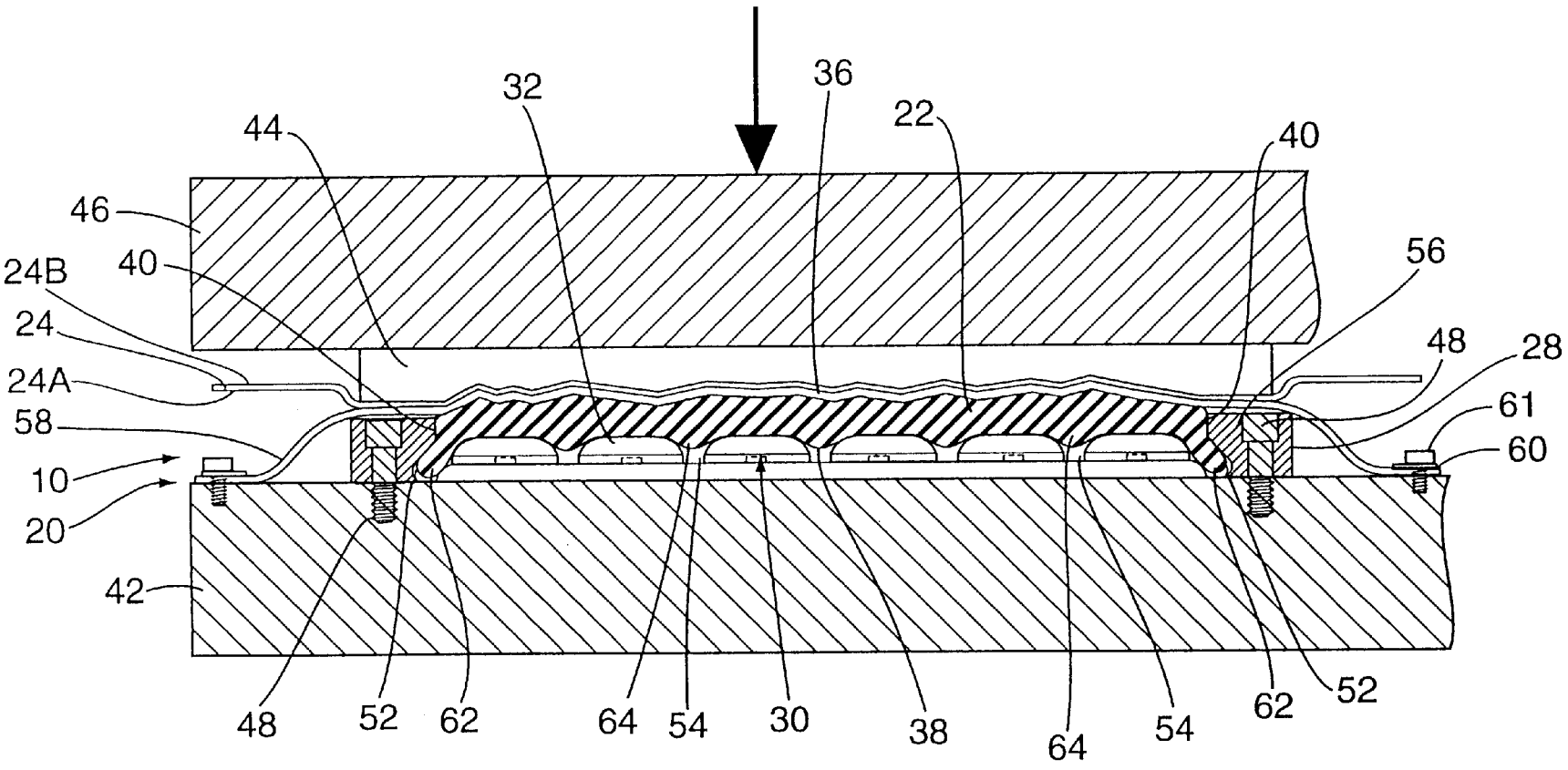
FIG. 4 is a sectional side view of the press assembly of FIG. 3 in a compressed state.

Turning to FIGS. 2–4, the flexible counter 10 is mounted to a fixed table or base 42, and a contoured female die 44 is mounted to a movable press 46 opposing the counter 10. As shown in FIGS. 3 and 4, the walls 28 of the flexible counter 10 are mounted directly to the base 42 by threaded screws 48. In another embodiment, the floor 26 may be deleted and the base 42 may also serve as the floor of the bolster 20. As shown in FIGS. 2–4, the sheet 24 of material to be embossed is positioned between the flexible counter 10 and the opposing female die 44. The counter 10 and female die 44 deformably press the sheet 24 to form an embossment thereon.

The sheet 24 may be paper, cardboard or some other deformable material suitable for embossing. The sheet 24 may be provided in precut sections or in the form of a continuous web, and may be positioned between the die 44 and flexible counter 10 by suitable sheet-moving equipment.

The embodiment of FIG. 2 shows an embossing system 50 including the flexible counter 10 and an additional flexible counter 110, both of which are mounted to the base 42 and respectively aligned under female dies 44, 144 which are mounted to an upper portion 46 of the press. The additional flexible counter 110 is similar to the flexible counter 10 described herein, having similar components including a bolster 112 and mat 122. The additional flexible counter 110 is shown having smaller width and length dimensions than the flexible counter 10. With the additional flexible counter 110, the embossing system 50 is capable of forming multiple embossments with a single pressing operation. Of course, more than two counter-die combinations could be provided at the embossing system 50. The dies 44, 144 and opposing counters 10, 110 are positioned to form embossments in desired locations of the sheet 24 depending on the particular application, patterns and products being produced. The embossing system 50 may be used as a station in a production line for manufacturing greeting cards or other products.

According to the invention, the flexible counter 10 supports the mat in a controlled manner. Specifically, the mat deformation caused by pressure from the contoured female die is directionally controlled, resulting in a "flow" behavior of the mat material which optimizes the embossing performance. In particular, at lower regions of the mat, the bolster has shaped recesses which accommodate "bulging" of the compressed rubber. This helps avoid undesirable lateral translation and stretching of the upper mat surface which reduces the risk of tearing the sheet.

For example, as illustrated in FIGS. 3 and 4, the flexible counter 10 is effective to support one side 24A of the sheet 24 during an embossing operation while the contoured female embossing die 44 presses against an opposite side 24B of the sheet 24 toward the flexible counter 10. FIG. 3 illustrates the embossing system 50 when the press 46 and die 44 are retracted, and FIG. 4 illustrates the embossing system 50 when the press 46 is forcing the die 44 toward the counter 10 to emboss the sheet 24. As the sheet 24 is embossed, the mat 22 deforms to match the contour of the die 44 and supports the sheet 24 under the embossed area.

According to an aspect of the invention, to accommodate the bulging portions of the mat 22 during compression, the bolster 20 is constructed to have one or more recesses adjacent the support surfaces 32, including, for example, a peripheral recess 52 and multiple bottom recesses 54. Forming the peripheral recess 52, each of the walls 28 of the bolster 20 has a chamfered interior edge 56 facing the mat 22. The peripheral recess 52 extends peripherally around a lower portion of the mat 22, surrounding a lower thickness of the mat 22. The bottom recesses 54 may be formed by gaps between the support surfaces 32 which support the mat 22. As shown in FIGS. 1–4, buttons 30 are mounted to the floor 26 in an array or pattern wherein the buttons 30 are spaced apart from each other to form the recesses 54.

As also illustrated in FIGS. 3 and 4, a friction-reducing film 58 is positioned between the mat 22 and the sheet 24. The film 58 reduces friction between the mat 22 and the sheet 24, thereby aiding to release the sheet 24 from the mat 22 after embossing and reducing a risk of damaging the sheet 24. The film 58 may be made of urethane, mylar, or some other suitable material. A urethane film product marketed by Astor Universal, a Markem Company, 3841 Greenway Circle, Lawrence, Kans., USA, called "CC010 Countercast Tuff Film" has been found to serve as a suitable material for the film 58. In one embodiment, the urethane film may have a thickness of:

| | Range | Preferred |
|---|---|---|
| Thickness (inches) | .003–.09 | 0.015 |

As illustrated in the embodiment of FIGS. 3–4, the film 58 is secured in position relative to the flexible counter 10 by clamping edges of the film 58 under braces 60 which are fastened to the base 42 by threaded screws 61.

In FIG. 3, the die 44 and press 46 are illustrated in a retracted or lifted position. While the die 44 is retracted, the sheet 24 is placed between the film 58 and the die 44, and the sheet 24 is positioned so that the desired area of the sheet. 24 to be embossed is aligned under the die 44.

Turning to FIG. 4, the press 46 is then actuated downwardly, thereby pressing the die 44 downwardly against the sheet 24. Pressure applied to the die 44 may vary from application to application depending on the type and thickness of the sheet material, the shape of the embossment, and other factors. In general, for typical greeting card embossments, a die pressure of about 2000 psi may be suitable. In one embodiment, the pressure, dwell time and temperature for a Gietz Press or Bobst Press would be as follows:

| | First Range | Second Range | Preferred |
|---|---|---|---|
| Pressure (psi) | 1000–10,000 | 1000–5000 | 2500 |
| Dwell Time (seconds) | 0–3.0 | 0–0.8 | 0.4 |
| Temperature (Fahrenheit) | 80°–300° | 130°–210° | 165° |

Still referring to FIG. 4, when the die 44 is pressed against the sheet 24, the sheet 24 contacts the film 58, which in turn is pressed against the mat 22, which in turn is supported by the bolster 20. The upper surface 36 of the mat 22 presses upwardly against the sheet 24 (through the film 58), opposing the die force and complementarily deforming to the contour of the die 44. The sheet 24 is embossed between the die 44 and the mat 22 to affect the desired embossment of the sheet 24. The die 44 is subsequently retracted, and the embossed sheet 24 is removed.

According to the invention, the mat 22 is supported by the support areas 32 and the walls 28 of the bolster 20 adjacent to the recesses 52, 54. As shown in FIG. 4, the mat 22 deforms against the buttons 30 and against the walls 28, causing peripheral lower portions 62 of the mat 22 to bulge into the peripheral recess 52. Additionally, bulging portions 64 at the lower surface 38 of the mat 22 bulge into the recesses 64 between the buttons 30. The ability of the mat 22 to bulge or "flow" in this manner away from the upper surface 36 of the mat 22 results in reliable embossing performance. The performance exhibited by the counter 10 may be partly due toga minimization of lateral stretching and translation at the upper surface 36 of the mat 22 from the stress-relieving deformation and "flow" permitted at lower regions of the mat 22 into the recesses 52, 54.

As illustrated in FIGS. 3 and 4, in order to avoid cutting or damaging the mat 22, each of the buttons 30 may be shaped so that the support surface 32 has no sharp angles or edges. In the illustrated embodiment, each of the buttons 30 is rounded in shape at the side which faces the mat 22. In an embodiment, a button may be rounded so that the support surface 32 has a cross-sectional radius of about one-quarter inch. In one embodiment, a button has a diameter of about 1.25 inches and a height of about 0.3 inches. Also, the buttons are spaced about 1.5 inches from the center of one button to the center of another button.

The buttons may have the following characteristics:

| | First Range | Second Range | Preferred |
|---|---|---|---|
| Diameter (inches) | 0.25–2.50 | 1–1.375 | 1.25 |
| Height (inches) | 0.0625–1.0 | 0.25–0.375 | 0.31 |
| Spacing (inches) | 0.5–5.0 | 1–1.75 | 1.5 |

Because the flexible counter 10 is resilient, the flexible counter 10 provides effective counter-support against a variety of female die contours. The flexible counter 10 eliminates a need for an expensive cooperatively-shaped male die. Moreover, the flexible counter 10 provides effective counter-support at any position where the mat 22 is adequately supported by the support members 30, preferably at locations spaced inwardly from the sides 40 of the mat 22. Accordingly, maintaining precise alignment of the flexible counter relative to the female die 44 is unnecessary.

The bolster 20 of the flexible counter 10 may be constructed in any appropriate shape which results in the desirable deformation characteristics of the mat 22. Particularly, the bolster 20 may be provided in any of a variety of shapes having suitable recesses to controllably accommodate bulging lower portions of the mat 22 in order to result in the desired behavior of the upper surface 36 of the mat 22.

Figure 5:
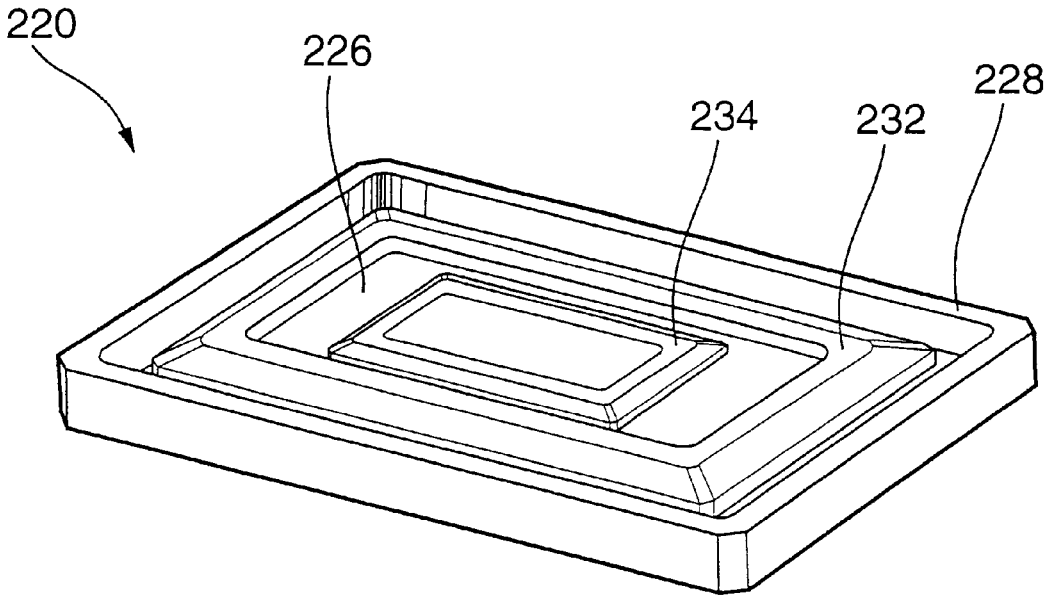
FIG. 5 is a perspective view of a bolster according to an embodiment of the invention having a floor constructed of multiple concentric loop-shaped members.
Figure 6:
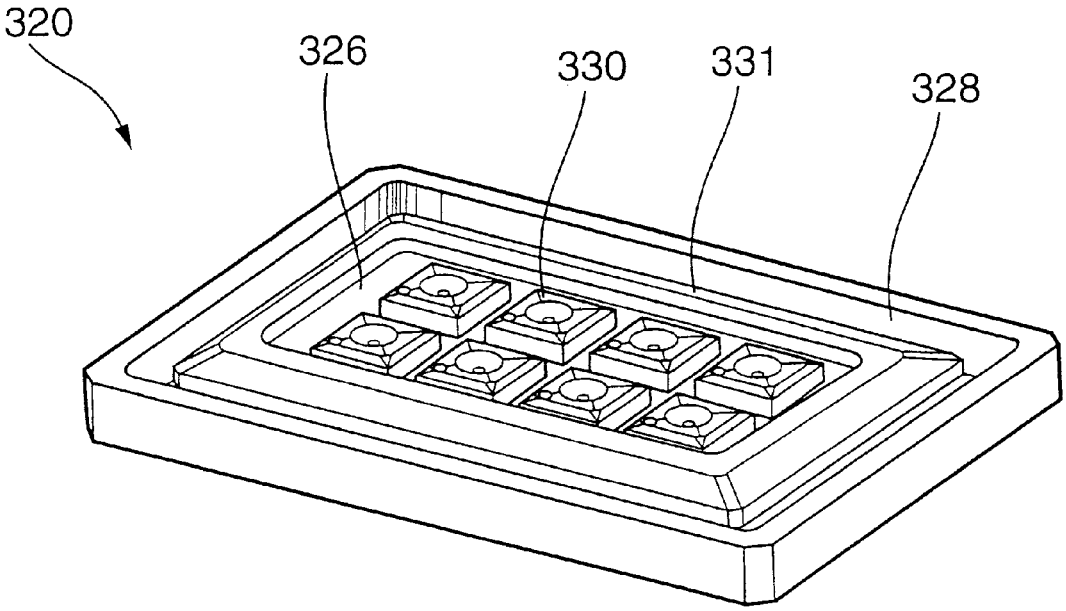
FIG. 6 is a perspective view of a bolster according to an embodiment of the invention having a waffle-pattern floor constructed of an array of square buttons.

For example, alternatively shaped bolsters 220 and 320 are illustrated in FIGS. 5 and 6, respectively. The bolster 220 illustrated in FIG. 5 has a plurality of generally loop-shaped support members 230, 232 arranged in a concentric and spaced manner. The loop-shaped support members 230, 232 are mounted to a common floor 226 within a rectangular wall 228 for peripherally surrounding sides of the mat. FIG. 6 illustrates bolster 320 having an array of spaced square or rectangular buttons 330 arranged in a waffle pattern. The buttons 330 are mounted to a common floor 326 within a rectangular loop-shaped support member 331 and a rectangular wall 328 for peripherally extending around sides of the mat.

While the invention is described herein in connection with certain embodiments, the invention is not limited to those embodiments. On the contrary, various changes and modifications to the described embodiments will be apparent to those skilled in the art, and such changes and modifications may be made without departing from the spirit and scope of the present invention. Accordingly, the appended claims are intended to cover all alternatives, modifications, and equivalents included within the spirit and scope of the invention.

What is claimed is:

1. A flexible counter for supporting a sheet when pressed by an embossing die, the counter comprising:

a resilient mat having a lower surface and an oppositely-directed upper surface; and a bolster including at least one support surface for supporting the lower surface of said resilient mat when said die presses against said upper surface, the bolster including at least one recess adjacent said at least one support surface, said recess defined by said at least one support surface and a lower surface in the bolster, said recess being located below said lower surface of said mat to accommodate deformation of the resilient mat when compressed by said die.

2. The invention as in claim 1 having a plurality of said support surfaces, said flexible counter further comprising:

a generally planar floor parallel to said mat; and a plurality of spaced support members mounted to said floor, each of the support members forming one of said support surfaces raised from the floor.

3. The invention as in claim 2, wherein at least one of said support members is a generally circular button.

4. The invention as in claim 3, wherein each of said buttons is generally annular and wherein each said support surface is rounded.

5. The invention as in claim 2, wherein at least one of said support members is a generally rectangular button.

6. The invention as in claim 2, wherein said at least some of said support members are of generally uniform size and are mounted to said floor in a pattern such that adjacent support members are spaced generally uniformly.

7. The invention as in claim 2, wherein at least some of said support members are generally loop-shaped and mounted to said floor concentrically.

8. The invention as in claim 7, wherein said loop-shaped support members are rectangular.

9. The invention as in claim 1, wherein the mat is made of gum rubber.

10. The invention as in claim 1, wherein said recess in said bolster generally extends around a periphery of a lower portion of said mat.

11. The invention as in claim 1, further comprising a friction-reducing film extending across said mat.

12. The invention as in claim 11, wherein said film has at least one edge mounted relative to said bolster.

13. The invention as in claim 11, wherein said film is made of mylar.

14. The invention as in claim 11, wherein said film is made of urethane.

15. The invention as in claim 1 having a peripheral wall fixed relative to the support surface and extending generally peripherally around sides of the mat.

16. The invention as in claim 15 wherein an upper thickness of said mat protrudes above said peripheral wall when said mat is supported on said support surface in an uncompressed condition.

17. The invention as in claim 15, wherein said mat has a generally uniform thickness, and wherein about one-half to one-third of said thickness protrudes from the bolster when said mat is supported on said support surface in an uncompressed condition.

18. The invention as in claim 15, wherein said peripheral wall has a chamfered interior edge facing said mat, said chiamfered edge forming at least one said recess at a lower portion of said mat.

19. The invention as claimed in claim 1, wherein the resilient mat has a generally uniform thickness.

20. An embossing system for embossing cards, the system comprising:

a movable die having a contoured surface;

a flexible counter opposing said die, the flexible counter including a resilient mat and a bolster for supporting the mat, the mat being compressible between said bolster and said die, the bolster having:

at least one support surface to support a bottom of the mat to oppose said die;

at least one recess defined in said bolster adjacent the support surface, said recess defined by said at least one support surface and a lower surface in the bolster; and a peripheral wall fixed relative to the support surface peripherally extending around a side of the mat.

21. The invention as in claim 20 wherein the bolster has a plurality of support surfaces and wherein said bolster further comprises:

a generally planar floor parallel to said mat; and a plurality of spaced support members mounted to said floor, each of the support members forming one of said support surfaces raised from the floor.

22. The invention as in claim 21, wherein some of said support members are generally circular and rounded in shape.

23. The invention as in claim 21, wherein at least some of said support members are rectangular and arranged in a waffle pattern.

24. The invention as in claim 21 wherein at least some of said support members are rectangular and are mounted to said floor concentric relative to each other.

25. The invention as in claim 20, wherein the mat is made of gum rubber.

26. The invention as in claim 20 wherein an upper thickness of said mat protrudes above said peripheral wall when said mat is supported on said support surface in an uncompressed condition.

27. The invention as in claim 26 wherein said thickness of the mat is generally uniform, and wherein about one-half to three-quarters of said thickness protrudes from the bolster when said mat is supported on said support surface in an uncompressed condition.

28. The invention as in claim 20, wherein said recess generally extends around a periphery of said a lower portion of said mat.

29. The invention as in claim 28, wherein said peripheral wall has a chamfered interior edge facing said mat, said chamfered edge forming said generally peripheral recess.

30. The invention as claimed in claim 20, wherein the resilient mat has a generally uniform thickness.

31. A flexible counter for supporting a sheet when pressed by an embossing die, the counter comprising:

a resilient mat having a lower surface and an oppositely-directed upper surface and a generally uniform thickness defined between said upper surface and lower surface; and a bolster for supporting the mat, the bolster including:

at least one support surface positioned to support said lower surface of the mat while said die presses against said upper surface to compress said mat;

a peripheral wall fixed relative to the support surface peripherally extending around the mat at a height such that an upper thickness of the mat protrudes above the wall when the mat is supported on the support surface in an uncompressed condition;

a recess in said bolster adjacent said support surface and below said lower surface of the mat to accommodate deformation of the mat when said mat is compressed, said recess defined by said at least one support surface and a lower surface in the bolster.

32. A flexible counter for supporting a sheet when pressed by an embossing die, the counter comprising:

a resilient mat;

a bolster for supporting the resilient mat, the bolster including at least one support surface supporting a bottom of the mat, the support surface being adjacent at least one recess to accommodate deformation of the resilient mat; and a friction-reducing film extending across said mat.

33. The flexible counter according to claim 32, wherein said film has at least one edge mounted relative to said bolster.

34. The flexible counter according to claim 32, wherein said film is made of mylar.

35. The flexible counter according to claim 32, wherein said film is made of urethane.

36. A flexible counter for supporting a sheet when pressed by an embossing die, the counter comprising:

a resilient mat;

a bolster for supporting the resilient mat; and a friction-reducing film extending across said mat.

37. The flexible counter according to claim 28, wherein said bolster comprises:

at least one support surface supporting a bottom of the mat to oppose said die;

a peripheral wall fixed relative to the support surface peripherally extending around a side of the mat.

38. The invention as claimed in claim 28, wherein said film has at least one edge mounted relative to said bolster.

39. The invention as in claim 28, wherein said film is made of mylar.

40. The invention as in claim 28, wherein said film is made of urethane.

* * * * *

UNITED STATES PATENT AND TRADEMARK OFFICE

CERTIFICATE OF CORRECTION

PATENT NO. : 6,186,936 B1
DATED : February 13, 2001
INVENTOR(S) : Smith et al.

It is certified that error appears in the above-identified patent and that said Letters Patent is hereby corrected as shown below:

Column 5,
Line 42, "toga" should read -- to a --.

Column 8, claim 37,
Line 54, "claim 28" should read -- claim 37 --.

Column 8, claim 38,
Line 60, "claim 28" should read -- claim 37 --.

Column 8, claim 39,
Line 62, "claim 28" should read -- claim 37 --.

Column 8, claim 40,
Line 64, "claim 28" should read -- claim 37 --.

Signed and Sealed this

First Day of January, 2002

*Attest:*

*Attesting Officer*

JAMES E. ROGAN
*Director of the United States Patent and Trademark Office*